US006336895B1

(12) United States Patent
Dukes

(10) Patent No.: US 6,336,895 B1
(45) Date of Patent: Jan. 8, 2002

(54) BUTTOCK AND TAIL BONE PROTECTION DEVICE FOR USE DURING SIT-UPS

(76) Inventor: Richard R. Dukes, 5854 S. Espana St., Aurora, CO (US) 80015-5107

( * ) Notice: Subject to any disclaimer, the term of this patent is extended or adjusted under 35 U.S.C. 154(b) by 0 days.

(21) Appl. No.: 09/502,305

(22) Filed: Feb. 11, 2000

(51) Int. Cl.[7] ..... A63B 26/00
(52) U.S. Cl. ..... 482/140; 602/19
(58) Field of Search ..... 482/140, 131, 482/139; 5/633; D21/687, 686; 128/845; 602/19; 297/452.21, 452.23, 452.24, 452.26; 604/358, 385.01

(56) References Cited

U.S. PATENT DOCUMENTS

| | | | | | |
|---|---|---|---|---|---|
| 1,904,039 | A | | 4/1933 | Bruder | |
| D152,394 | S | * | 1/1949 | Ceverha | D83/1 |
| 3,434,469 | A | * | 3/1969 | Swift | 128/78 |
| D226,601 | S | * | 4/1973 | Cushion | D6/9 |
| 4,535,495 | A | * | 8/1985 | Oldfield | 5/432 |
| 4,752,067 | A | | 6/1988 | Colonello | |
| 5,033,742 | A | | 7/1991 | Johnson et al. | |
| D343,877 | S | | 2/1994 | Yin et al. | |
| 5,520,624 | A | * | 5/1996 | Amato | 602/19 |
| 5,722,923 | A | | 3/1998 | Lui | |
| 5,887,951 | A | * | 3/1999 | Willingham | 297/452 |
| 5,916,073 | A | * | 6/1999 | Ellis | 482/140 |

* cited by examiner

*Primary Examiner*—Justine R. Yu

(57) ABSTRACT

A buttock and tail bone protection device for use during sit-ups for protecting the tail bone region when doing sit-ups especially on a hard floor. The buttock and tail bone protection device for use during sit-ups includes a thin flexible support member having a smooth bottom side and a contoured top side with a ridge having a first end at one of the vertexes and extending centrally upon the top side and ending short of a side which is opposed to the vertex. The ridge is adapted to fit about the tail bone region of the user including the crevice between the buttock.

8 Claims, 2 Drawing Sheets

FIG. 1
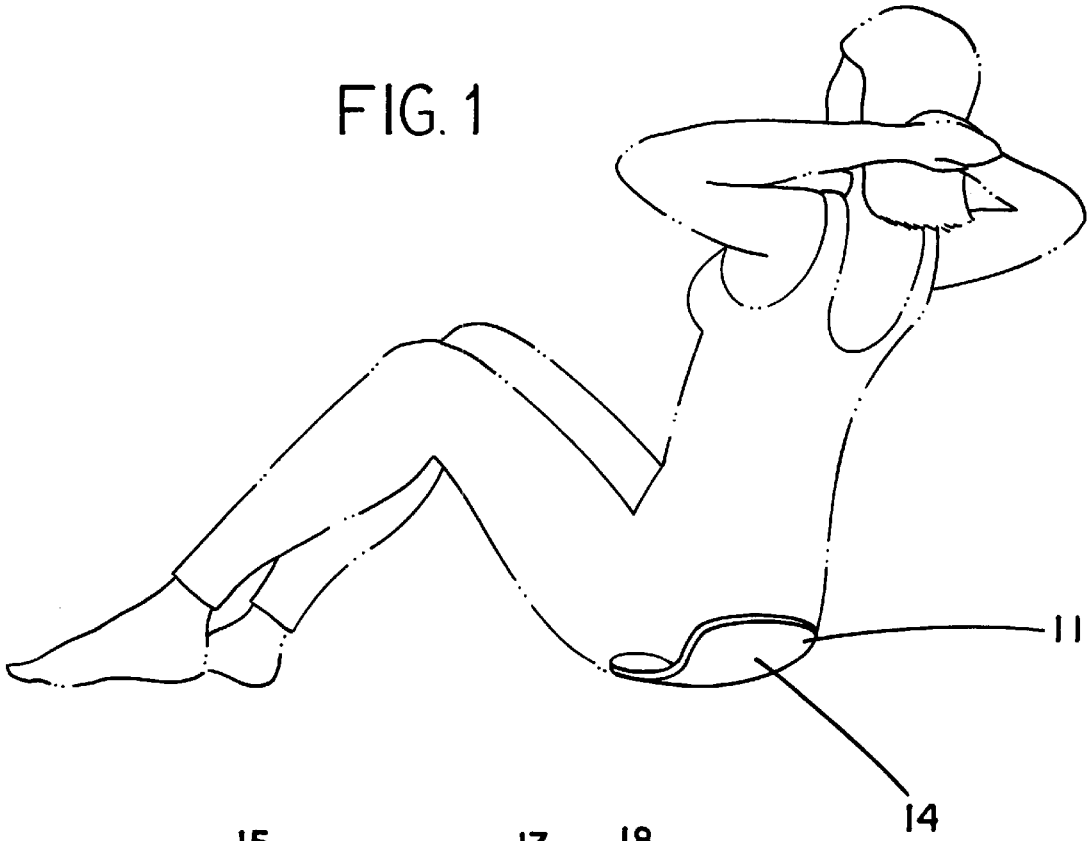
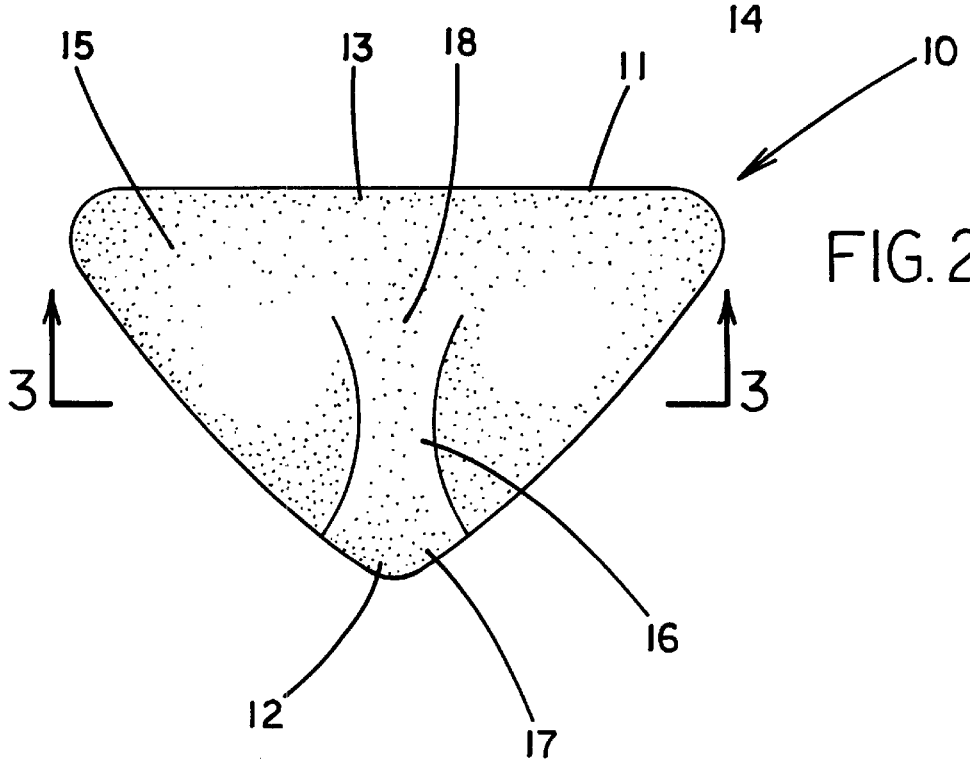
FIG. 2

FIG. 3
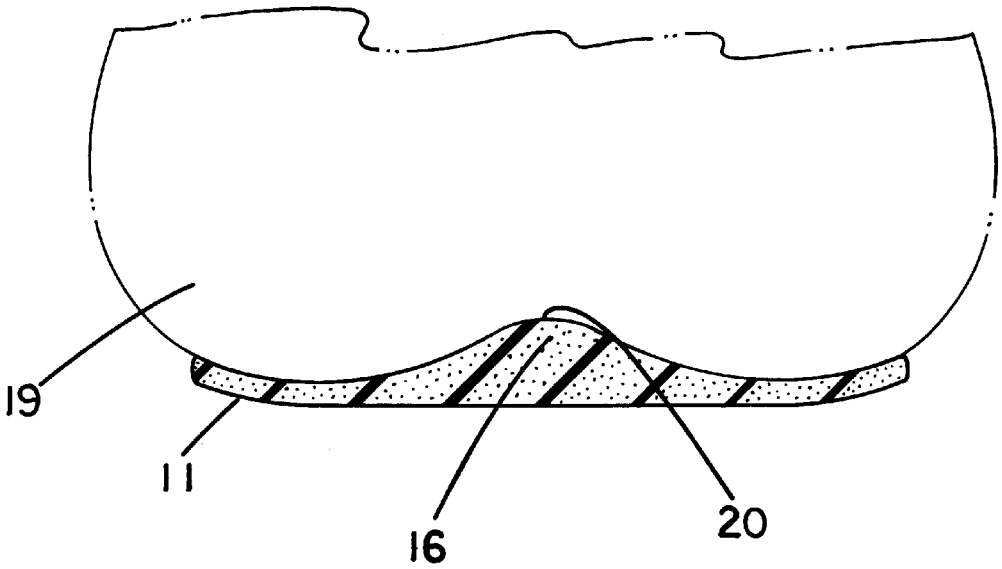
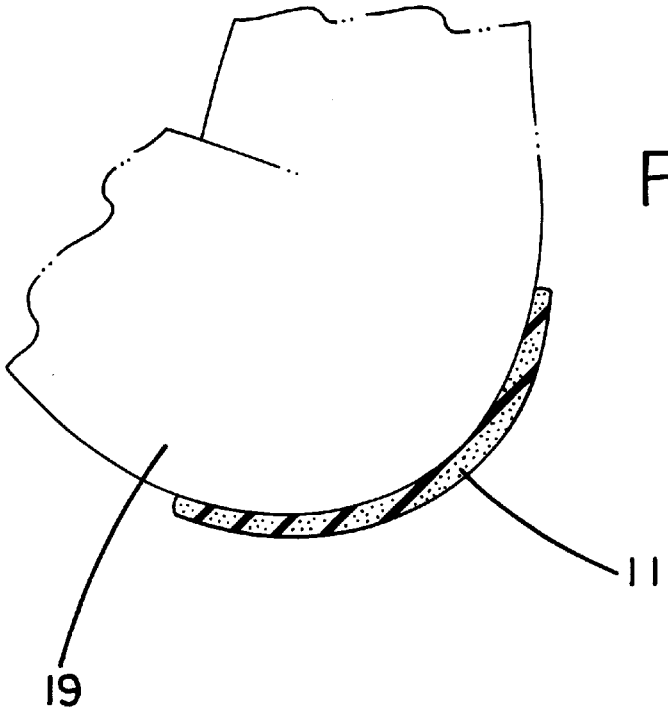
FIG. 4

BUTTOCK AND TAIL BONE PROTECTION DEVICE FOR USE DURING SIT-UPS

BACKGROUND OF THE INVENTION

1. Field of the Invention

The present invention relates to a means for protecting one's tail bone region during sit-ups and more particularly pertains to a new buttock and tail bone protection device for use during sit-ups for protecting the tail bone region when doing sit-ups especially on a hard floor.

2. Description of the Prior Art

The use of a means for protecting one's tail bone region during sit-ups is known in the prior art. More specifically, a means for protecting one's tail bone region during sit-ups heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,752,067; U.S. Pat. No. Des. 343,877; U.S. Pat. No. Des. 152,394; U.S. Pat. No. 5,722,923; U.S. Pat. Nos. 5,033,742; and 1,904,039.

While these devices fulfill their respective, particular objectives and requirements, the aforementioned patents do not disclose a new buttock and tail bone protection device for use during sit-ups. The inventive device includes a thin flexible support member having a smooth bottom side and a contoured top side with a ridge having a first end at one of the vertexes and extending centrally upon the top side and ending short of a side which is opposed to the vertex. The ridge is adapted to fit about the tail bone region of the user including the crevice between the buttock.

In these respects, the buttock and tail bone protection device for use during sit-ups according to the present invention substantially departs from the conventional concepts and designs of the prior art, and in so doing provides an apparatus primarily developed for the purpose of protecting the tail bone region when doing sit-ups especially on a hard floor.

SUMMARY OF THE INVENTION

In view of the foregoing disadvantages inherent in the known types of means for protecting one's tail bone region during sit-ups now present in the prior art, the present invention provides a new buttock and tail bone protection device for use during sit-ups construction wherein the same can be utilized for protecting the tail bone region when doing sit-ups especially on a hard floor.

The general purpose of the present invention, which will be described subsequently in greater detail, is to provide a new buttock and tail bone protection device for use during sit-ups which has many of the advantages of the means for protecting one's tail bone region during sit-ups mentioned heretofore and many novel features that result in a new buttock and tail bone protection device for use during sit-ups which is not anticipated, rendered obvious, suggested, or even implied by any of the prior art a means for protecting one's tail bone region during sit-ups, either alone or in any combination thereof.

To attain this, the present invention generally comprises a thin flexible support member having a smooth bottom side and a contoured top side with a ridge having a first end at one of the vertexes and extending centrally upon the top side and ending short of a side which is opposed to the vertex. The ridge is adapted to fit about the tail bone region of the user including the crevice between the buttock.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new buttock and tail bone protection device for use during sit-ups apparatus and method which has many of the advantages of the means for protecting one's tail bone region during sit-ups mentioned heretofore and many novel features that result in a new buttock and tail bone protection device for use during sit-ups which is not anticipated, rendered obvious, suggested, or even implied by any of the prior art a means for protecting one's tail bone region during sit-ups, either alone or in any combination thereof.

It is another object of the present invention to provide a new buttock and tail bone protection device for use during sit-ups which may be easily and efficiently manufactured and marketed.

It is a further object of the present invention to provide a new buttock and tail bone protection device for use during sit-ups which is of a durable and reliable construction.

An even further object of the present invention is to provide a new buttock and tail bone protection device for use during sit-ups which is susceptible of a low cost of manufacture with regard to both materials and labor, and which accordingly is then susceptible of low prices of sale to the consuming public, thereby making such buttock and tail bone protection device for use during sit-ups economically available to the buying public.

Still yet another object of the present invention is to provide a new buttock and tail bone protection device for use during sit-ups which provides in the apparatuses and methods of the prior art some of the advantages thereof, while simultaneously overcoming some of the disadvantages normally associated therewith.

Still another object of the present invention is to provide a new buttock and tail bone protection device for use during sit-ups for protecting the tail bone region when doing sit-ups especially on a hard floor.

Yet another object of the present invention is to provide a new buttock and tail bone protection device for use during sit-ups which includes a thin flexible support member having a smooth bottom side and a contoured top side with a ridge having a first end at one of the vertexes and extending centrally upon the top side and ending short of a side which is opposed to the vertex. The ridge is adapted to fit about the tail bone region of the user including the crevice between the buttock.

Still yet another object of the present invention is to provide a new buttock and tail bone protection device for use during sit-ups that essentially cushions the tail bone region during sit-ups.

Even still another object of the present invention is to provide a new buttock and tail bone protection device for use during sit-ups that provides a more comfortable surface upon which sit-ups can be done.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new buttock and tail bone protection device for use during sit-ups according to the present invention as being used.

FIG. 2 is a top plan view of the present invention.

FIG. 3 is a rear elevational view of the present invention being used.

FIG. 4 is a side elevational view of the present invention being used.

DESCRIPTION OF THE PREFERRED EMBODIMENT

With reference now to the drawings, and in particular to FIGS. 1 through 4 thereof, a new buttock and tail bone protection device for use during sit-ups embodying the principles and concepts of the present invention and generally designated by the reference numeral 10 will be described.

As best illustrated in FIGS. 1 through 4, the buttock and tail bone protection device for use during sit-ups 10 generally comprises a thin flexible support member 11 having a smooth bottom side 14 and a contoured top side 15 and being adapted to be inserted in a user's clothing. The thin flexible support member 11 is essentially triangular shaped with the top side 15 of the thin flexible support member 11 having a ridge 16 centrally disposed thereupon and being adapted to fit about a tail bone region 20 of a user. The ridge 16 has a first end 17 which begins at one of the vertexes 12 of the thin flexible support member 11 and further has a second end 18 which terminates short of a side 13 of the thin flexible support member 11 with the side 13 being opposed to the vertex 12 and interconnecting the other vertexes of the thin flexible support member 11. The ridge 16 is generally perpendicular to the opposed side 13 and is curved to conform to a user's tail bone region 20 including a crevice of the user's buttock 19. The thin flexible support member 11 is from 3 to 5 inches long, 3 to 5 inches wide, and ¼ to 1 inch thick.

In use, the thin flexible support member 11 is inserted inside the clothing of the user and is positioned about the buttock region 19,20 with the ridge 16 being disposed in the crevice of the buttock 19 and about the tail bone region 20. As the user does sit-ups, the thin flexible support member 11 cushions the tail bone and buttock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A buttock and tail bone protection device for use during sit-ups comprising:

a thin flexible support member having a smooth bottom side and a contoured top side and being adapted to be inserted in a user's clothing and positioned about a user's buttock and tail bone region;

said thin flexible support member having an outer perimeter which is generally triangular in shape with three sides;

a ridge being formed on said top side of said thin flexible support member for positioning in cleavage between buttocks of the user, said ridge having a ridge surface portion of said top side which is raised with respect to a remainder surface portion of said top side.

2. A buttock and tail bone protection device as described in claim 1, wherein said ridge has a first end which begins at a first vertex of said thin flexible support member, said ridge extending toward and being generally perpendicular to a first side of said thin flexible support member, said side being opposed to said vertex and interconnecting second and third vertexes of said thin flexible support member.

3. A buttock and tail bone protection device as described in claim 2, wherein said ridge extends approximately two-thirds of a distance between said first vertex of said support member and said first side of said support member.

4. A buttock and tail bone protection device as described in claim 1, wherein said ridge is curved to conform to a user's tail bone region including a crevice between the user's buttock.

5. A buttock and tail bone protection device as described in claim 1, wherein the sides of the perimeter of said support member include a first side having a relatively longer length and second and third sides having relatively shorter lengths with respect to the length of the first side, said ridge extending from a vertex between the second and third sides toward the first side.

6. A buttock and tail bone protection device as described in claim 5, wherein the second and third sides are substantially equal in length.

7. A buttock and tail bone protection device as described in claim 1, wherein the perimeter of said support member is an isosceles triangle.

8. A buttock and tail bone protection device for use during sit-ups comprising:

a thin flexible support member having a smooth bottom side and a contoured top side and being adapted to be inserted in a user's clothing and positioned about a user's buttock and tail bone region;

said thin flexible support member having an outer perimeter which is generally triangular in shape with three sides;

a ridge being formed on said top side of said thin flexible support member for positioning in cleavage between buttocks of the user, said ridge having a ridge surface portion of said top side which is raised with respect to a remainder surface portion of said top side;

wherein said ridge has a first end which begins at a first vertex of said thin flexible support member, said ridge extending toward and being generally perpendicular to a first side of said support member, said side being opposed to said first vertex and interconnecting second and third vertexes of said support member;

wherein the sides of the perimeter of said support member include the first side having a relatively longer length and second and third sides having relatively shorter lengths with respect to the length of the first side, said ridge extending from a vertex between the second and third sides;

wherein the second and third sides are substantially equal in length;

wherein the perimeter of said support member is an isosceles triangle;

wherein said thin flexible support member is from 3 to 5 inches long, 3 to 5 inches wide, and ¼ to 1 inch thick; and wherein said ridge extends approximately two-thirds of a distance between said first vertex of said support member and said first side of said support member.

* * * * *